US010355414B1

(12) United States Patent
Alvarado

(10) Patent No.: US 10,355,414 B1
(45) Date of Patent: Jul. 16, 2019

(54) CONNECTOR WITH A CONNECTOR POSITION ASSURANCE DEVICE

(71) Applicant: Delphi Technologies, LLC, Troy, MI (US)

(72) Inventor: Eduardo Diaz Alvarado, Coahuila (MX)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/891,863

(22) Filed: Feb. 8, 2018

(51) Int. Cl.
*H01R 13/627* (2006.01)
*H01R 13/639* (2006.01)
*H01R 13/641* (2006.01)

(52) U.S. Cl.
CPC ..... *H01R 13/641* (2013.01); *H01R 13/6272* (2013.01); *H01R 13/6273* (2013.01); *H01R 13/6275* (2013.01); *H01R 13/639* (2013.01)

(58) Field of Classification Search
CPC H01R 13/641; H01R 13/639; H01R 13/6272; H01R 13/6275; H01R 13/6273
USPC ..... 439/352, 489, 910
See application file for complete search history.

(56) References Cited

U.S. PATENT DOCUMENTS 4,634,204 A 1/1987 Detter et al.
4,892,490 A 1/1990 Tsuchiya et al.
4,906,204 A * 3/1990 Metzger ..... H01R 13/641 439/352
4,938,710 A 7/1990 Aihara et al.
4,946,395 A 8/1990 Cope et al.
4,946,404 A 8/1990 Takenouchi et al.
4,950,179 A 8/1990 Takenouchi et al.
5,120,255 A 6/1992 Kouda et al.
5,234,356 A 8/1993 Maejima et al.
5,257,944 A 11/1993 Kennedy
5,330,369 A 7/1994 Nozaki et al.
5,370,550 A 12/1994 Alwine et al.
5,507,666 A 4/1996 Yamanashi
5,605,471 A 2/1997 Plyler
5,605,472 A 2/1997 Sakai et al.
5,624,271 A 4/1997 Childs et al.
5,643,003 A * 7/1997 Myer ..... H01R 13/6272 439/352
5,672,073 A 9/1997 Matsumura et al.
5,720,623 A 2/1998 Polenick et al.
5,759,058 A 6/1998 Childs et al.
5,775,930 A 7/1998 Model et al.
(Continued)

*Primary Examiner* — Gary F Paumen
(74) *Attorney, Agent, or Firm* — Robert J. Myers

(57) ABSTRACT

A connector assembly is provided with a connector body that is configured to be removably connected with a corresponding mating connector body. The connector body has a deflectable latching member configured to secure the connector body to the corresponding mating connector body. The connector assembly also includes a connector position assurance (CPA) device that is slideably attached to the connector body and is moveable from a pre-staged position that allows the latching member to be deflected to a full-staged position that inhibits deflection of the latching member. The latching member defines a first window and a second window. A first portion of the CPA device is visible in the first window when the CPA device is in the pre-staged position and a second portion of the CPA device is visible in the second window when the CPA device is in the full-staged position.

18 Claims, 3 Drawing Sheets

(56) References Cited

U.S. PATENT DOCUMENTS 5,803,651 A 9/1998 Saito
5,823,814 A 10/1998 Alwine
5,839,915 A 11/1998 Ford et al.
5,879,180 A 3/1999 Iwahori et al.
5,910,027 A 6/1999 Wayt et al.
5,928,038 A 7/1999 Berg et al.
6,004,153 A 12/1999 Myer et al.
6,045,388 A 4/2000 Higgins et al.
6,068,507 A 5/2000 Popa
6,109,955 A 8/2000 Hanazaki et al.
6,244,890 B1 6/2001 Fuerst et al.
6,261,115 B1 7/2001 Pederson et al.
6,261,116 B1 * 7/2001 Ceru ..... H01R 13/6272 439/352
6,312,277 B1 11/2001 Holub
6,354,860 B1 3/2002 Miller et al.
6,406,319 B2 6/2002 Pederson et al.
6,435,895 B1 8/2002 Fink et al.
6,461,186 B1 10/2002 Endo
6,468,105 B2 10/2002 Noguchi et al.
6,514,098 B2 2/2003 Marpoe, Jr. et al.
6,572,400 B2 6/2003 Noguchi et al.
6,592,390 B1 7/2003 Davis et al.
6,659,789 B2 12/2003 Nagamine et al.
6,705,886 B1 3/2004 Brown
6,716,052 B2 4/2004 Kane
6,780,045 B2 8/2004 Shuey et al.
6,811,424 B2 11/2004 Seminara et al.
6,817,883 B2 11/2004 Raudenbush et al.
6,824,417 B1 11/2004 Nimura
6,857,892 B2 2/2005 McLauchlan et al.
6,908,329 B2 6/2005 Kozono et al.
6,921,279 B2 7/2005 Sian et al.
6,945,801 B2 9/2005 Brown
7,201,599 B2 4/2007 Holub
7,255,593 B2 8/2007 Tyler
7,326,074 B1 2/2008 Lim et al.
7,347,709 B2 3/2008 Burkhard et al.
7,399,195 B2 7/2008 Kim et al.
7,442,065 B2 10/2008 Kuwayama
7,470,138 B1 12/2008 Chen et al.
7,601,019 B2 10/2009 Hsieh et al.
7,682,181 B1 3/2010 Jones, Jr. et al.
7,909,638 B2 3/2011 Seo et al.
7,980,887 B2 7/2011 Urano et al.
8,016,606 B1 9/2011 Kwan et al.
9,728,896 B2 8/2017 Papurcu et al.
2003/0003792 A1 1/2003 Endo
2003/0096527 A1 5/2003 Greiner
2003/0157825 A1 8/2003 Kane
2003/0171027 A1 9/2003 Shuey et al.
2004/0087206 A1 5/2004 Grubbs
2004/0132329 A1 7/2004 Shimoyama et al.
2004/0157486 A1 8/2004 Brown
2004/0166715 A1 8/2004 Parrish et al.
2004/0248453 A1 12/2004 McLauchlan et al.
2004/0248459 A1 12/2004 Sian et al.
2005/0142923 A1 6/2005 Horiuchi
2005/0176297 A1 8/2005 Dillon
2005/0208818 A1 9/2005 Mtchedlishvili et al.
2006/0223355 A1 10/2006 Hirschmann
2008/0124966 A1 5/2008 Lim
2009/0023325 A1 1/2009 Chen et al.
2009/0035981 A1 2/2009 Lim
2010/0233897 A1 9/2010 Seo et al.
2011/0212644 A1 * 9/2011 Itzenhuiser ..... H01R 13/62955 439/352
2012/0156917 A1 6/2012 Sasho et al.
2012/0282791 A1 11/2012 Brown et al.
2013/0078835 A1 3/2013 Gunreben et al.
2013/0210266 A1 8/2013 Osada et al.
2013/0260590 A1 10/2013 Hitchcock et al.

* cited by examiner

CONNECTOR WITH A CONNECTOR POSITION ASSURANCE DEVICE

TECHNICAL FIELD OF THE INVENTION

The invention relates to connectors, particularly connectors including a connector position assurance device.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a connector assembly having a connector body and a corresponding mating connector body that is configured to mate with the connector body. The connector bodies each contain termination elements or "terminals" for wire electrical cables, fiber optic cables, pneumatic lines, hydraulic lines, etc. The connector body includes a latching member that is configured to secure the connector body to the mating connector body when the connector bodies are fully mated. The connector body also includes a connector position assurance (CPA) device that is moveable from a pre-staged position to a fully-staged position only after the latching member has secured the first connector body to the second connector body. The CPA device is also configured to inhibit actuation of the latching member when it is in the full-staged position, thereby, making inadvertent disconnection of the connector body from the mating connector body less likely. The connector body defines a pair or windows through which a portion of the CPA device may be viewed by an assembly operator. When the CPA device is in the pre-staged position, the CPA may be visible to the operator in a first window but is not visible to the operator in a second window. When the CPA device is in the full-staged position, the CPA device may be visible to the operator in the second window.

Figure 1:
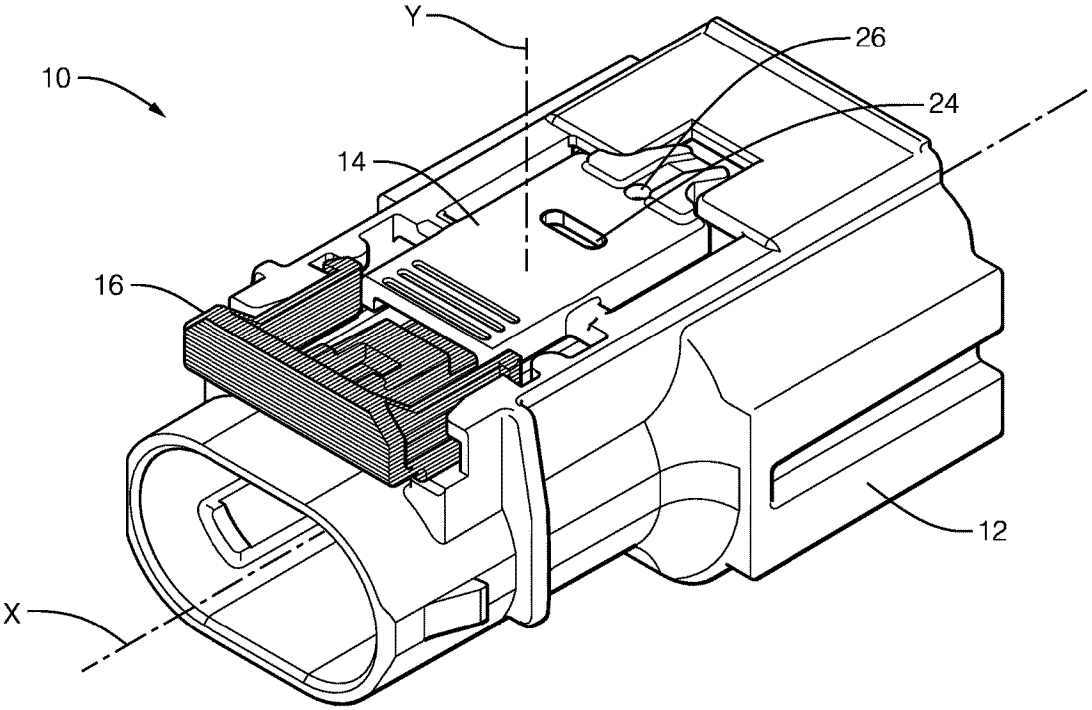
FIG. 1 is perspective view of a connector assembly according to one embodiment of the invention.
Figure 2:
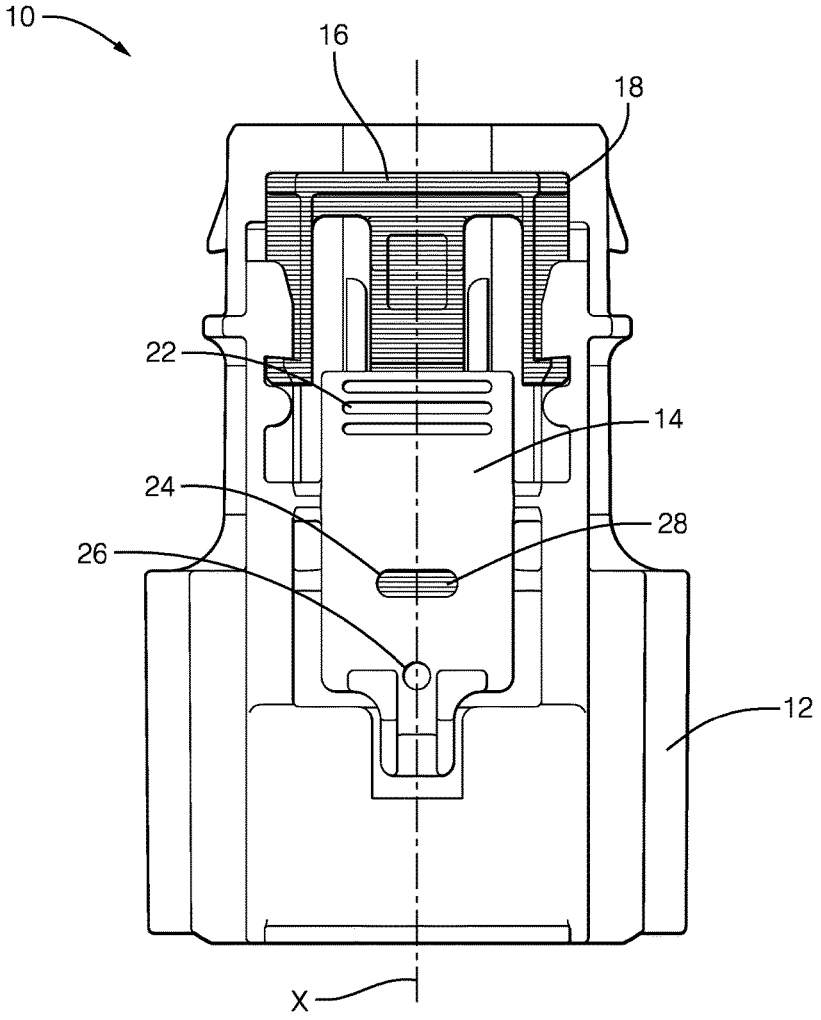
FIG. 2 is a top view of the connector system of FIG. 1 with a connector position assurance (CPA) device in a pre-staged position according to one embodiment of the invention.
Figure 3:
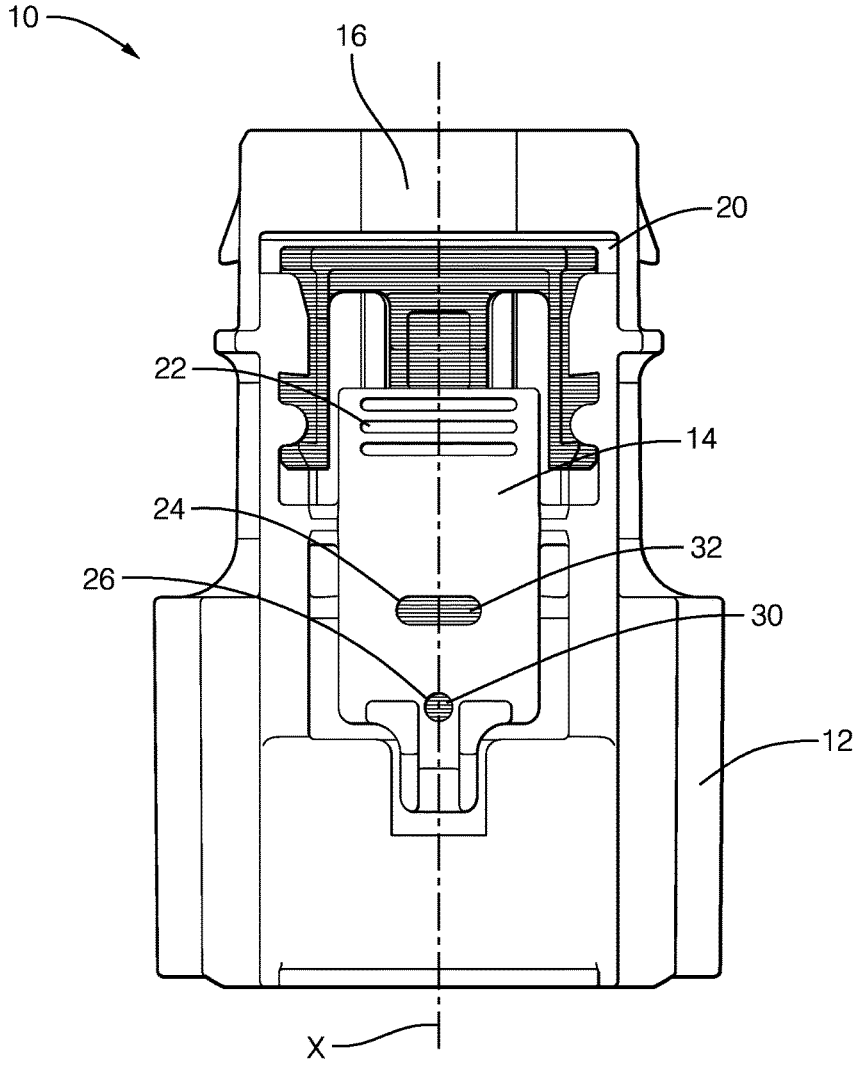
FIG. 3 is a top view of the connector system of FIG. 1 with the CPA device in a full-staged position according to one embodiment of the invention.

FIGS. 1 through 3 illustrate a non-limiting example of a connector assembly 10. The connector assembly 10 includes a connector body 12 that is configured to be removably connected with a corresponding mating connector body (not shown). The connector body 12 has a deflectable latching member 14 that is configured to secure the connector body 12 to the corresponding mating connector body. The design and operation of latching members for connector assemblies are well known to those skilled in the art.

The connector assembly 10 also includes a CPA device 16 that is slideably attached to the connector body 12. The CPA device 16 is moveable from a pre-staged position 18, shown in FIG. 2, to a full-staged position 20 shown inn FIG. 3. When in the pre-staged position 18, the CPA device 16 allows the latching member 14 to be deflected by engagement with a latching nib (not shown) on the mating connector or by an operator pressing on an end 22 of the latching member 14 to disengage the latching member 14 from the latching nib. When the CPA device 16 is in the full-staged position 20, the CPA device 16 inhibits deflection of the latching member 14, particularly by pressing on the end 22 of the latching member 14. The CPA device 16, the latching member 14, and the connector body 12 are configured to inhibit movement of the CPA device 16 from the pre-staged position 18 to the full-staged position 20 until the connector body 12 is fully mated with the mating connector body and the latching member 14 has lockingly engaged the latching nib of the mating connector body.

As shown in FIGS. 2 and 3, the latching member 14 defines a first pre-staged window 24 and a second full-staged window 26 separate from the pre-staged window 24 and forward of the pre-staged window 24 along a longitudinal mating axis X of the connector body 12. Portions of the CPA device 16 may be visible through one or both of these windows 24, 26 when the latching member 14 is viewed along a lateral axis Y that is generally perpendicular to the longitudinal axis X. As used herein, generally perpendicular means±45° of absolutely perpendicular.

As illustrated in FIG. 2, a portion 28 of the CPA device 16 is visible in the pre-staged window 24 and the CPA device 16 is not visible in the full-staged window 26 when the CPA device 16 is in the pre-staged position 18.

When the CPA device 16 is moved along the longitudinal axis X from the pre-staged position 18 to the full-staged position 20, a portion 30 of the CPA device 16 is now visible in the full-staged window 26 as shown in FIG. 3. Another portion 32 of the CPA is also visible in the pre-staged window 24. The pre-staged and full-staged windows 24, 26 are configured to provide the assembly operator with visible confirmation that the CPA device 16 is in the pre-staged or in the full-staged position 20.

As seen in FIGS. 2 and 3, the pre-staged and full-staged windows 24, 26 have different shapes, in this particular example, the pre-staged window 24 has an oval shape and the full-staged window 26 has a round shape. The difference in shapes of the pre-staged and full-staged windows 24, 26 may help the operator distinguish between the pre-staged and full-staged positions of the CPA device 16. As can further be seen in FIGS. 2 and 3, the CPA device 16 and the latching member 14 are different colors, preferably different colors with high contrast. This feature may further help the operator distinguish between the pre-staged and full-staged positions of the CPA device 16.

Accordingly, a connector assembly 10 is provided. The latching member 14 of the connector body 12 includes a pair of windows 24, 26 that allow an operator to view a portion 28, 30, 32 of the CPA device 16 allowing visual conformation whether the CPA device 16 is in the pre-staged position 18 or the full-staged position 20. This confirmation of CPA device 16 position may improve the quality of connection between the connector body 12 and the mating connector body.

The example presented herein is directed to an electrical connector assembly, however other embodiments may be envisioned that are adapted for use with optical cables or hybrid connectors including both electrical and optical cable connections. Yet other embodiments of the connector system may be envisioned that are configured to interconnect pneumatic or hydraulic lines.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

I claim:

1. A connector assembly, comprising:

a connector body;

a corresponding mating connector body configured to be removably connected with the connector body, wherein the connector body has a deflectable latching member configured to secure the connector body to the corresponding mating connector body and wherein the latching member defines a first window and a second window distinct from the first window; and a connector position assurance (CPA) device slideably attached to the connector body and moveable from a pre-staged position that allows the latching member to be deflected to a full-staged position that inhibits deflection of the latching member, wherein a first portion of the CPA device is visible in the first window when the CPA device is in the pre-staged position, and wherein a second portion of the CPA device is visible in the second window through the mating connector body when the CPA device is in the full-staged position.

2. The connector assembly according to claim 1, wherein a third portion of the CPA device is visible in the first window when the CPA device is in the full-staged position.

3. The connector assembly according to claim 2, wherein the first portion of the CPA device and the second portion of the CPA device are the same portion.

4. The connector assembly according to claim 1, wherein the first window and the second window have different shapes.

5. The connector assembly according to claim 1, wherein the CPA device and the latching member are different colors.

6. The connector assembly according to claim 1, wherein, when the CPA device is in the pre-staged position and when the connector body is viewed along a lateral axis that is substantially perpendicular to a longitudinal mating axis of the connector body, the first portion of the CPA device is visible in the first window and the first portion of the CPA is not visible in the second window.

7. A method for operating a connector assembly, comprising the steps of:

providing a connector body;

providing a corresponding mating connector body configured to be removably connected with the connector body, wherein the connector body has a deflectable latching member configured to secure the connector body to the corresponding mating connector body and wherein the latching member defines a first window and a second window distinct from the first window; and providing a connector position assurance (CPA) device;

slideably attaching the CPA device to the connector body; and moving the CPA device from a pre-staged position that allows the latching member to be deflected to a full-staged position that inhibits deflection of the latching member, wherein a first portion of the CPA device is visible in the first window when the CPA device is in the pre-staged position, and wherein a second portion of the CPA device is visible in the second window through the mating connector body when the CPA device is in the full-staged position.

8. The method according to claim 7, wherein a third portion of the CPA device is visible in the first window when the CPA device is in the full-staged position.

9. The method according to claim 8, wherein the first portion of the CPA device and the second portion of the CPA device are the same portion.

10. The method according to claim 7, wherein the first window and the second window have different shapes.

11. The method according to claim 7, wherein the CPA device and the latching member are different colors.

12. The method according to claim 7, wherein, when the CPA device is in the pre-staged position and when the connector body is viewed along a lateral axis that is substantially perpendicular to a longitudinal mating axis of the connector body, the first portion of the CPA device is visible in the first window and the first portion of the CPA is not visible in the second window.

13. A connector assembly, comprising:

a connector body;

a corresponding mating connector body configured to be removably connected with the connector body, wherein the connector body has a deflectable latching member configured to secure the connector body to the corresponding mating connector body; and a connector position assurance (CPA) device slideably attached to the connector body and moveable from a pre-staged position that allows the latching member to be deflected to a full-staged position that inhibits deflection of the latching member;

a first viewing means configured for visually confirming location of a first portion of the CPA device when the CPA device is in the pre-staged position; and a second viewing means configured for visually confirming location of a second portion of the CPA device when the CPA device is in the full-staged position during complete mating of the connector bodies.

14. The connector assembly according to claim 13, wherein the first viewing means is configured for visually confirming location of a third portion of the CPA device when the CPA device is in the full-staged position.

15. The connector assembly according to claim 14, wherein the first portion of the CPA device and the second portion of the CPA device are the same portion.

16. The connector assembly according to claim 13, wherein the first viewing means and the second viewing means have different shapes.

17. The connector assembly according to claim 13, wherein the CPA device and the latching member are different colors.

18. The connector assembly according to claim 13, wherein, when the CPA device is in the pre-staged position and when the connector body is viewed along a lateral axis that is substantially perpendicular to a longitudinal mating axis of the connector body, the first portion of the CPA device is visible via the first viewing means and the first portion of the CPA is not visible via the second viewing means.

* * * * *